United States Patent [19]

McIntosh et al.

[11] Patent Number: 4,468,129

[45] Date of Patent: Aug. 28, 1984

[54] SOLIDS MIXING APPARATUS

[75] Inventors: George C. McIntosh, Dansville; Jonathan C. Everdyke, Canandaigua; Marlin D. Schutte, Rochester, all of N.Y.

[73] Assignee: General Signal Corp., Rochester, N.Y.

[21] Appl. No.: 496,778

[22] Filed: May 20, 1983

[51] Int. Cl.[3] ..... B01F 9/02

[52] U.S. Cl. ..... 366/213; 269/71; 269/239; 366/222; 366/224

[58] Field of Search ..... 366/210, 211, 213, 215, 366/220, 222, 223, 224, 236, 237, 238, 331, 605, 214, 235, 56, 63; 414/680; 51/164.1; 269/71, 239; 294/88, 104; 403/361

[56] References Cited

U.S. PATENT DOCUMENTS

| | | | |
|---|---|---|---|
| 838,661 | 12/1906 | Stadtmuller | 366/222 |
| 1,367,732 | 2/1921 | Christensen | 366/222 |
| 3,176,967 | 4/1965 | Hartley | 366/220 |
| 3,374,584 | 3/1968 | Haught | 51/164.1 |
| 4,004,783 | 1/1977 | Wilson | 366/224 X |
| 4,077,613 | 3/1978 | Wilson | 366/213 |
| 4,100,616 | 7/1978 | Wilson | 366/213 |

FOREIGN PATENT DOCUMENTS

| | | | |
|---|---|---|---|
| 1080072 | 4/1960 | Fed. Rep. of Germany | 366/220 |

*Primary Examiner*—Philip R. Coe

*Attorney, Agent, or Firm*—Martin Lukacher; Jeffrey S. Mednick

[57] ABSTRACT

Apparatus for mixing particulate material carried in separable containers or process modules rotated with the longitudinal axis thereof at an angle other than 90° to the axis of rotation thereof so that the container rotates asymmetrically with respect to the longitudinal axis thereof. The containers have mixing or process bars rotatably mounted therein and extending also at an angle other than 90° so as to be horizontal when the container is in position for asymmetrical rotation during mixing operations. A docking station of the apparatus has a column connected to the drive shaft at the angle other than 90°, an upper arm and a lower arm which is connected to the column and to actuators which tilt the lower arm from a horizontal, container receiving position to a position essentially parallel to the upper arm for clamping the container therebetween. A coupling, between the mixing bar and a shaft which rotates the bar, has a detent which provides for automatic engagement and alignment without manual intervention.

43 Claims, 8 Drawing Figures

SOLIDS MIXING APPARATUS

DESCRIPTION

The present invention relates to solids mixing apparatus for mixing, blending and carrying out other processes involving mixing or blending operations, such as break down, dispersion, agglomerate formation, coating or de-dusting with solid particulate material, and particularly to solids mixing apparatus in which the solids are carried in separable, portable containers in which the solids are located while they are mixed, blended or otherwise processed.

The invention is especially suitable for mixing of solid particulate materials, which may include powders, both coarse and fine, alone or together with liquids, wherein the containers which carry the material and in which the material is contained in being mixed, are being rotated with asymmetrical motion of the longitudinal axis of the containers (the axis which runs between the top and bottom of the containers). Such solids mixing apparatus is offered by Mixing Equipment Co., of Rochester, N.Y., U.S.A. as their LIGHTNIN (R) CBM (TM) containerized batch mixing system. Asymmetrical motion includes and is sometimes called X and Y motion, where X motion involves a generally symmetric, wobble motion of the longitudinal axis.

In order that the mixing containers may be revolved with asymmetric motion of longitudinal axis, the container must be revolved with its longitudinal axis at an angle less than 90° (such that the longitudinal axis of the container is tilted at an angle other than normal to the horizontal axis while the container revolves about that horizontal axis). The containers vary in size and may, for example, be from ten to one hundred and fifteen cubic feet in capacity. Loading or docking of the containers to enable them to be revolved with X or Y motion presents great difficulty. The containers of larger size are usually carried in lift or fork trucks with their longitudinal axis vertical. It is desirable that the containers be loaded into the docking station of the mixing machine while their longitudinal axis is vertical, instead of resorting to special purpose lift trucks or other materials handling machinery. Containers also are not constructed to high tolerances; they may be dented or warped, especially after long usage. Thus, the docking station must be capable of accommodating variations in size and shape of the containers in receiving the containers and maintaining them in place while they are rotated during mixing operations.

The problem of loading or docking containers is further exacerbated when the containers are equipped with mixing or processing bars which extend through the containers at an angle less than 90° so as to be driven by horizontal shafts in the mixing machine. It is desirable that the coupling between the mixing bar and the drive shaft therefore be made automatically without manual interaction to enhance the safety of the operation. The mixing bar is offset from the drive shaft during loading. Furthermore, the offset depends on the size and location of the mixing bar in the container, since the containers vary in size, and may be deformed and dented. Moreover, the containers may not be loaded precisely to position the mixing bar for coupling with the drive shaft. All such variations and deviations in size and position of the mixing bar as it extends from the drive shaft must be accommodated, if automatic coupling is to be accomplished during loading or docking operations.

Accordingly, it is an object of the present invention to provide improved solids mixing apparatus wherein a container carrying the material to be mixed may be conveniently and automatically docked for rotation with asymmetrical motion about its longitudinal axis.

It is another object of the present invention to provide improved solids mixing apparatus, in which containers containing the solids and in which they are transported between mixing operations and rotated during such operations, can be loaded and docked and their mixing or processing bars coupled with the drive shafts therefor so as to enable rotation of the containers with asymmetrical (X or Y) motion of the longitudinal axis of the container.

It is a further object of the present invention to provide improved solids mixing apparatus for use with portable containers carrying the materials to be mixed having a docking station which accepts the containers with their longitudinal axes vertical and docks the containers despite differences in dimensions and shapes thereof.

It is a still further object of the present invention to provide improved solids mixing apparatus for use with containers carrying the materials to be mixed, which tilts and translates the containers to a clamped position for rotation with asymmetrical motion about the longitudinal axis thereof.

It is a still further object of the present invention to provide improved solids mixing apparatus for use with containers carrying the materials to be mixed, which does not require special fixtures in the container for aligning and holding the container during docking.

It is a still further object of the present invention to provide improved solids mixing apparatus in which containers carrying the materials to be mixed have processing or mixing bars rotatably mounted therein, wherein the mixing bar is automatically coupled to a drive shaft therefor during loading or docking of the container in spite of misalignments or offsets between the bar and its drive shaft, such as is due to variations in size and shape of the container or the location of the bar therein.

It is a still further object of the present invention to provide improved containerized solids mixing apparatus which enables the automatic coupling of a processing or mixing bar while the container is tilted and/or translated during docking to a position where it may be revolved with asymmetrical (X or Y) motion of its longitudinal axis.

Briefly described, solids mixing apparatus embodying the invention may be containerized batch mixing apparatus in which portable containers carry the solids to be mixed, both during transport between mixing operations and during mixing operations. The containers may have mixing bars rotatably mounted therein which are disposed at an angle of less than 90° with respect to the longitudinal axis of the container. A mixing station is provided in which the containers are individually received and rotated with asymmetrical motion of the longitudinal axis thereof, such motion including both X and Y motion of the longitudinal axis about a horizontal axis. The station has a first drive shaft for rotating the container and a second drive shaft, which may revolve at a higher speed than the first drive shaft, for rotating the mixing bar. A docking station includes a frame, which is attached to the first drive shaft. This frame has a member disposed at the angle of less than 90° with respect to the axis of the first drive shaft, with a fixed upper arm presenting a first clamping surface and a lower arm which is movably connected to the member presenting a second clamping surface. The lower arm is mounted to the member by means which provide compound, tilting and translational movement of the second clamping surface between the horizontal and a position paralleling the first clamping surface whereby the container can be received upon the clamping surface of the lower arm while horizontal, tilted, and then translated into clamping relationship between the clamping surfaces of the upper and lower arms. Coupling means are provided having interengageable male and female members, one of which is connected to the mixing bar and the other to the drive shaft therefor. These interengageable members have mating drive surfaces which are rectilinear in cross-section (square or hexagonal, for example). The coupling also has means which mount one of the interengageable members as a detent and enables the drive surfaces to align and engage each other in driving relationship when the container is tilted and translated into position for rotation, and upon initiation of the rotation of the mixing bar drive shaft.

The foregoing and other objects, features and advantages of the invention, as well as a presently preferred embodiment thereof, will become more apparent from a reading of the following description in connection with the accompanying drawings in which.

Figure 1:
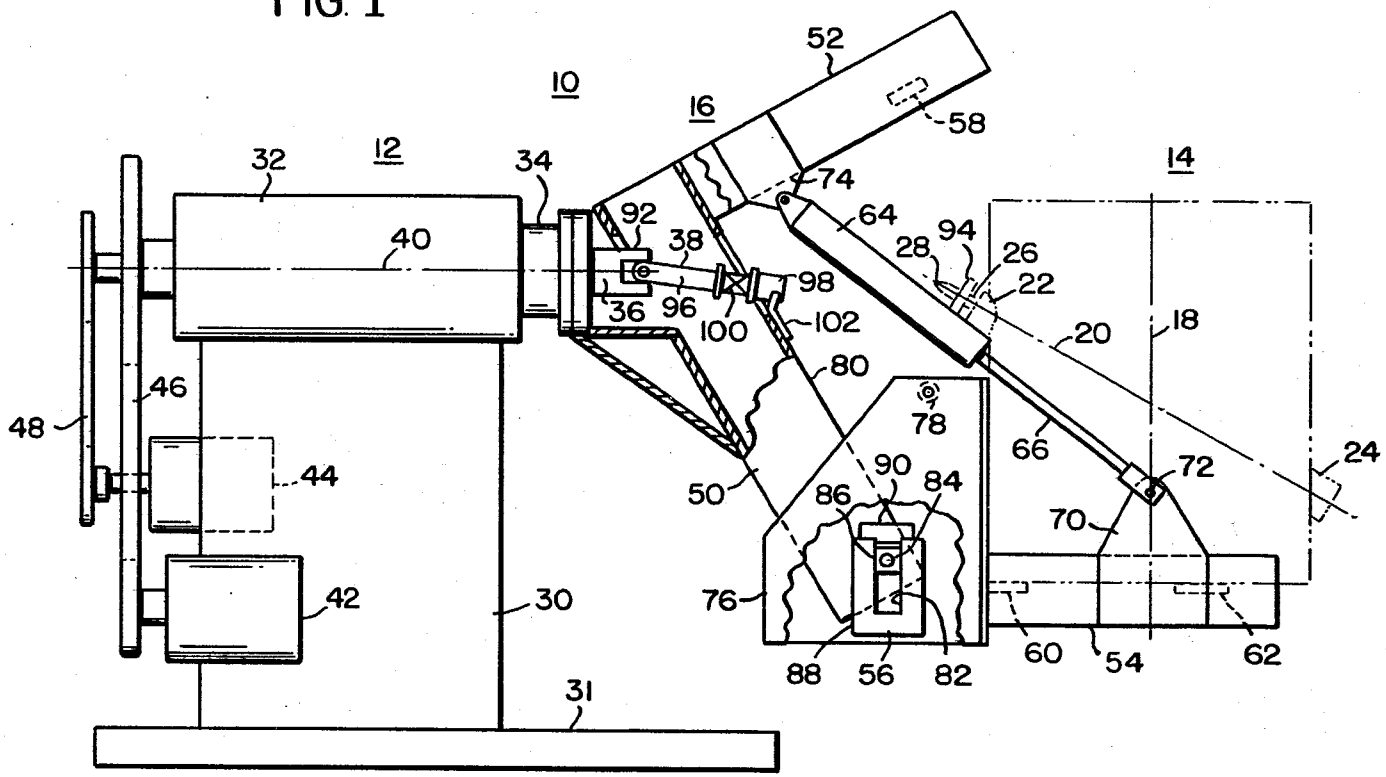
FIG. 1 is a view in elevation of containerized solids mixing apparatus embodying the invention in position for receiving a container.
Figure 2:
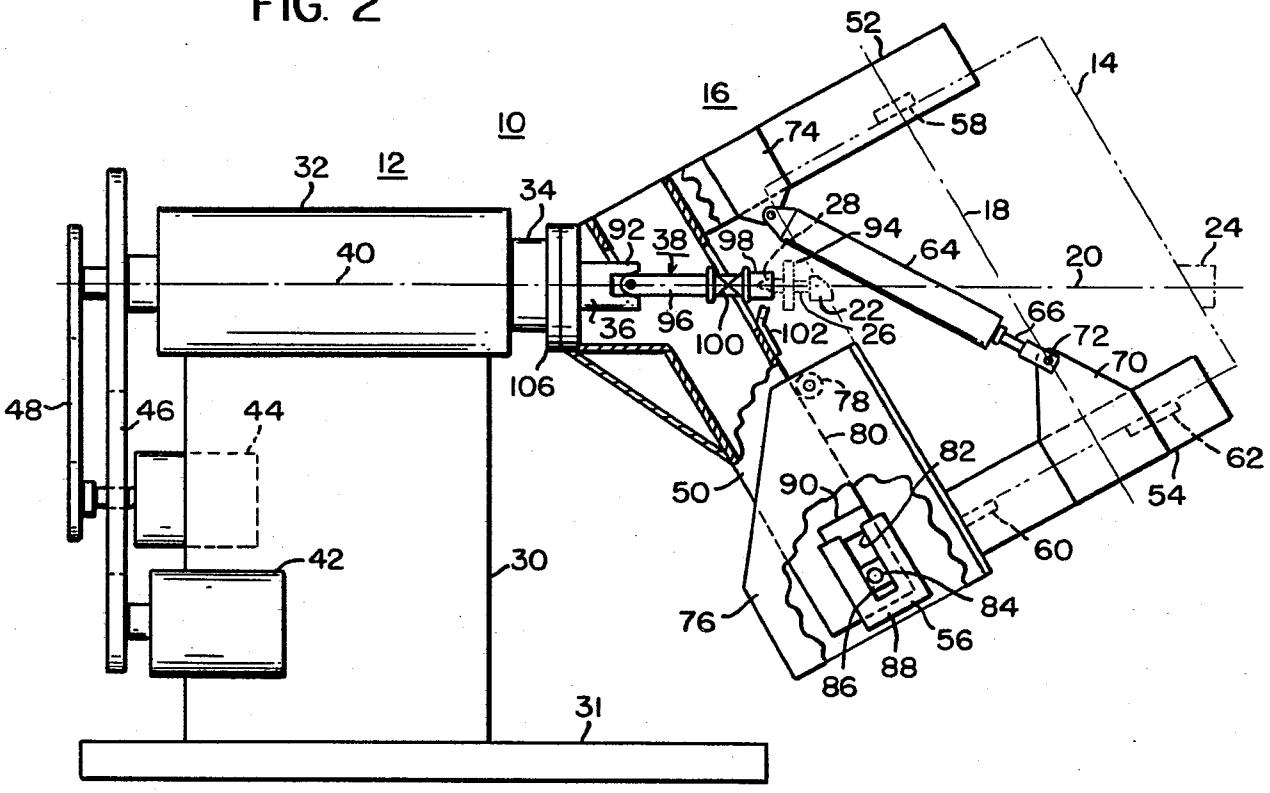
FIG. 2 is a view in elevation similar to FIG. 1 with the container docked in position for rotation to provide asymmetrical (X or Y) motion of its longitudinal axis.
Figure 3:
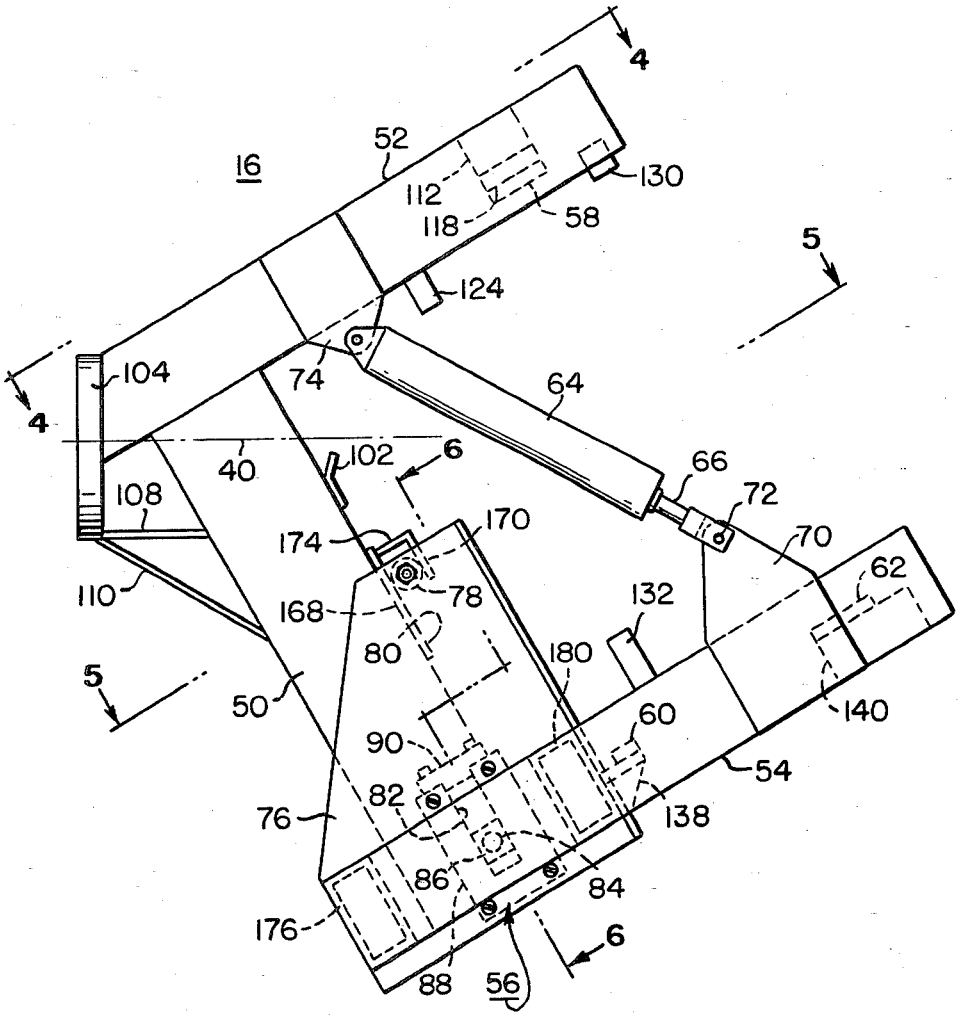
FIG. 3 is a view in elevation illustrating the docking station of the containerized solids mixing apparatus in greater detail, but without the coupling to the mixing or processing bar of the container not shown.

Referring more particularly to FIGS. 1 and 2, there is shown containerized solids mixing apparatus 10 having a mixing machine 12 which receives the containers 14 at its docking station 16. The containers are generally cylindrical, although other shapes may be used. The materials to be mixed or processed may be loaded into the container from the top. A batch of material may partially fill a container. While the material is usually in the form of particles of various size, liquids may also be included in the charge of material in the container. The apparatus 10 is designed for use with containers of substantial size, for example of 50 gallon or 100–150 cubic foot capacity. Such containers, particularly where processes such as agglomerate formation and breakdown, intimate dispersion of liquids, particle coating or dedusting and similar processes are to be carried out during mixing, are provided with a mixing or processing bar which is rotatably mounted in the walls of the container and extends there across. This mixing bar may have one or more impellers attached thereto and rotatable therewith. When the container is designed to be rotated with asymmetrical motion of its longitudinal axis 18 (X or Y motion), the axis 20 of the processing bar desirably intersects the longitudinal axis 18 at an angle less than 90°. This angle is 60° and approximately midway between the top and bottom of the container 14 as shown on the drawing. Accordingly, the container 14 is rotated with X motion of its longitudinal axis 18, in this illustrated embodiment of the invention. Stanchions 22 and 24, in which the trunions which rotatably mount the mixing bar are disposed, are also inclined at the angle of less than 90° with respect to the longitudinal axis 18 of the container. A portion 26 of the mixing bar shaft extends through one of these trunions 22. To this portion is attached the male member 28 of a coupling through which the mixing bar is driven.

The mixing machine 12 has a standard 30 which rests as on rails 31 on the floor. This standard 30 supports a drive 32 for a drive shaft 34 which rotates the entire docking station 16 and a shaft 36 which rotates, suitably at higher speed than the outer shaft 34 and is coupled to the mixing bar at its male part 28 by a female member 38 of the coupling. It will be appreciated, as the description proceeds, that the female end of the coupling may be mounted on the mixing bar shaft 26, while the male end is mounted on the drive shaft 36 for the mixing bar. Both the station drive shaft 34 and the mixing bar drive shaft 36 have their axis 40 horizontal. Drive motors 42 and 44 are mounted on the standard 30 and coupled to the drive 32, which may contain gearing and bearings, through belt and pulley or chain and sprocket mechanisms 46 and 48. These mechanisms 46 and 48 drive the station shaft 34 and the mixing bar shaft 36, respectively.

The docking or loading station 16 has, as its principal parts, a member in the form of a column 50, an upper arm 52 which is fixably attached to the column 50 at the upper end thereof, and a lower arm 54 which is attached near the lower end of the column by means, illustrated as a pin or shaft and slot mechanism 56, which provides for tilting (pivotal) and translational movement of the lower arm longitudinally along the column 50, that is in the direction between the lower and upper arms 54 and 52.

Figure 4:
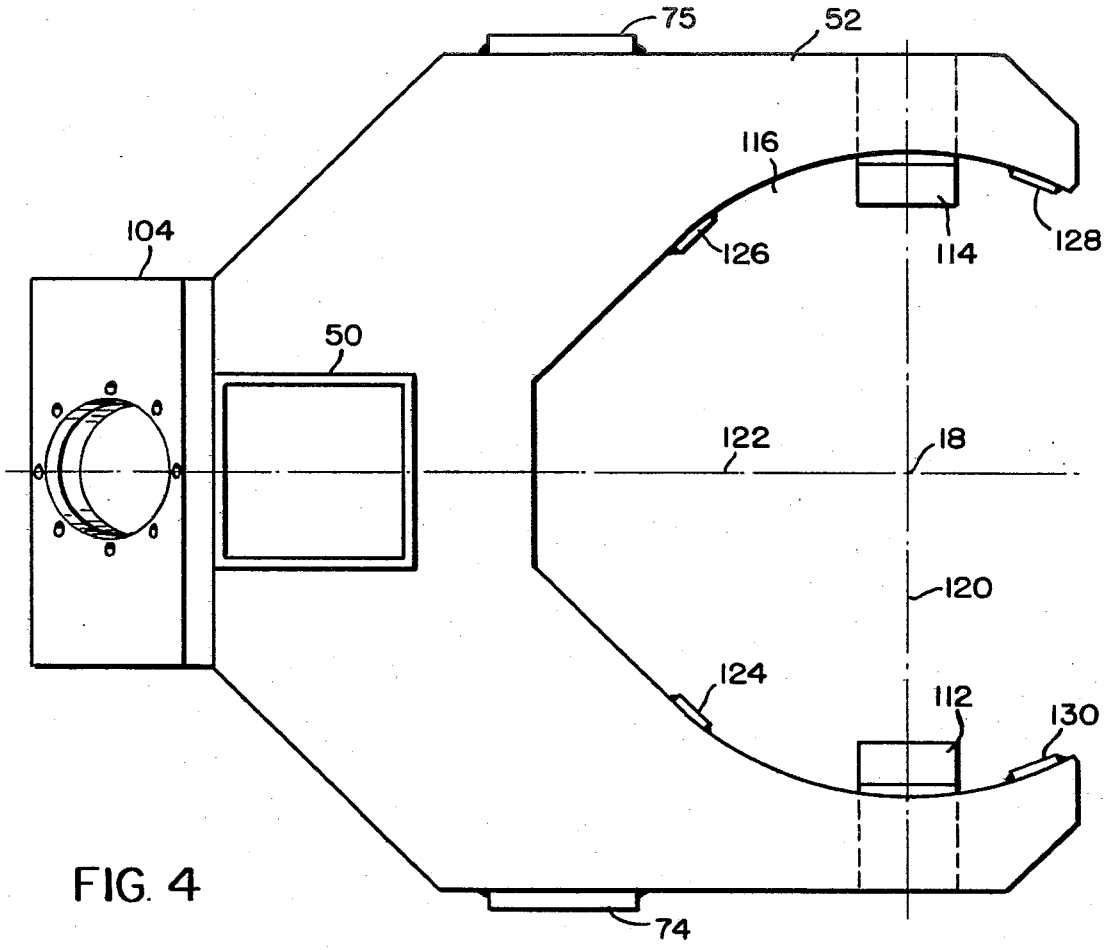
FIG. 4 is a top view of the docking station taken along the line 4—4 in FIG. 3.
Figure 5:
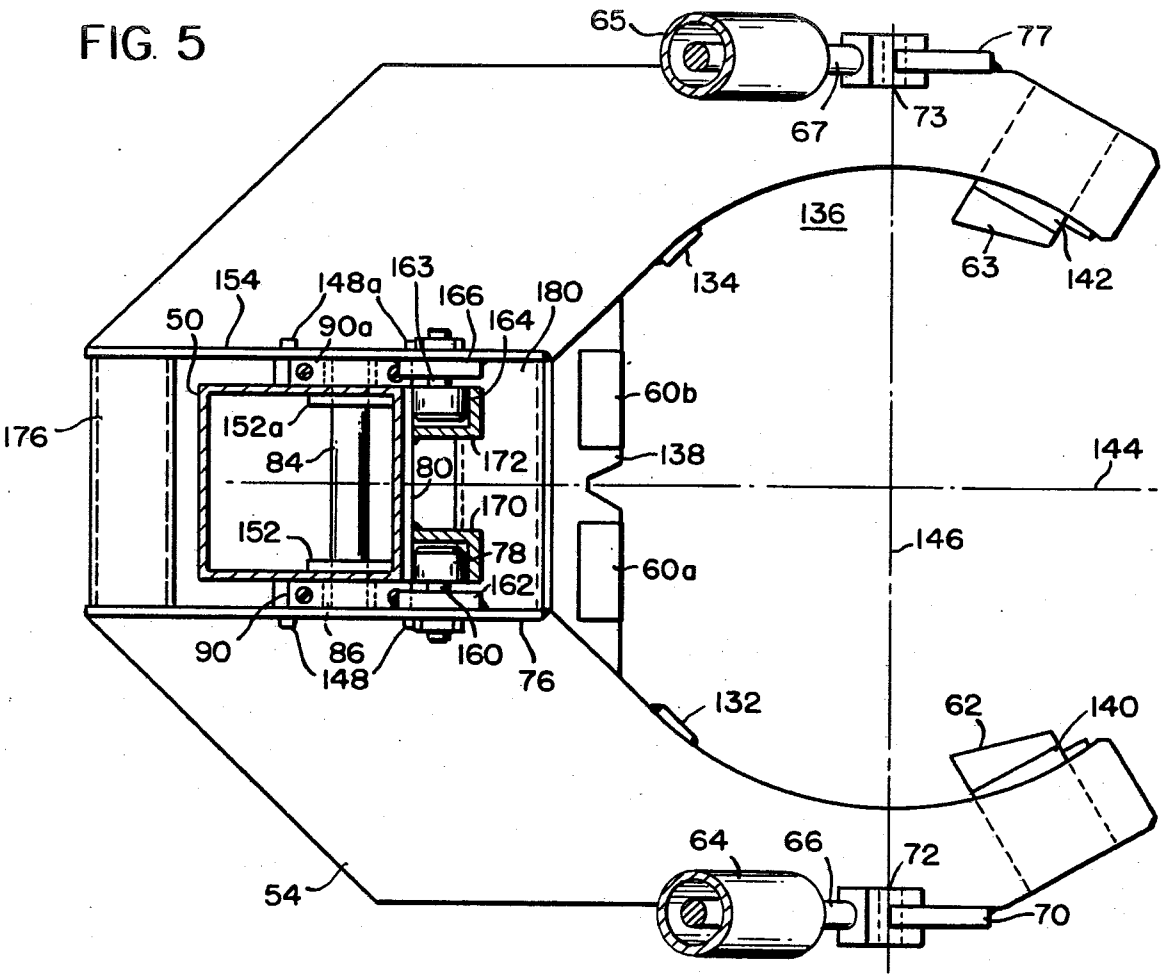
FIG. 5 is a sectional view through the central portion of the docking station taken along the line 5—5 in FIG. 3.
Figure 6:
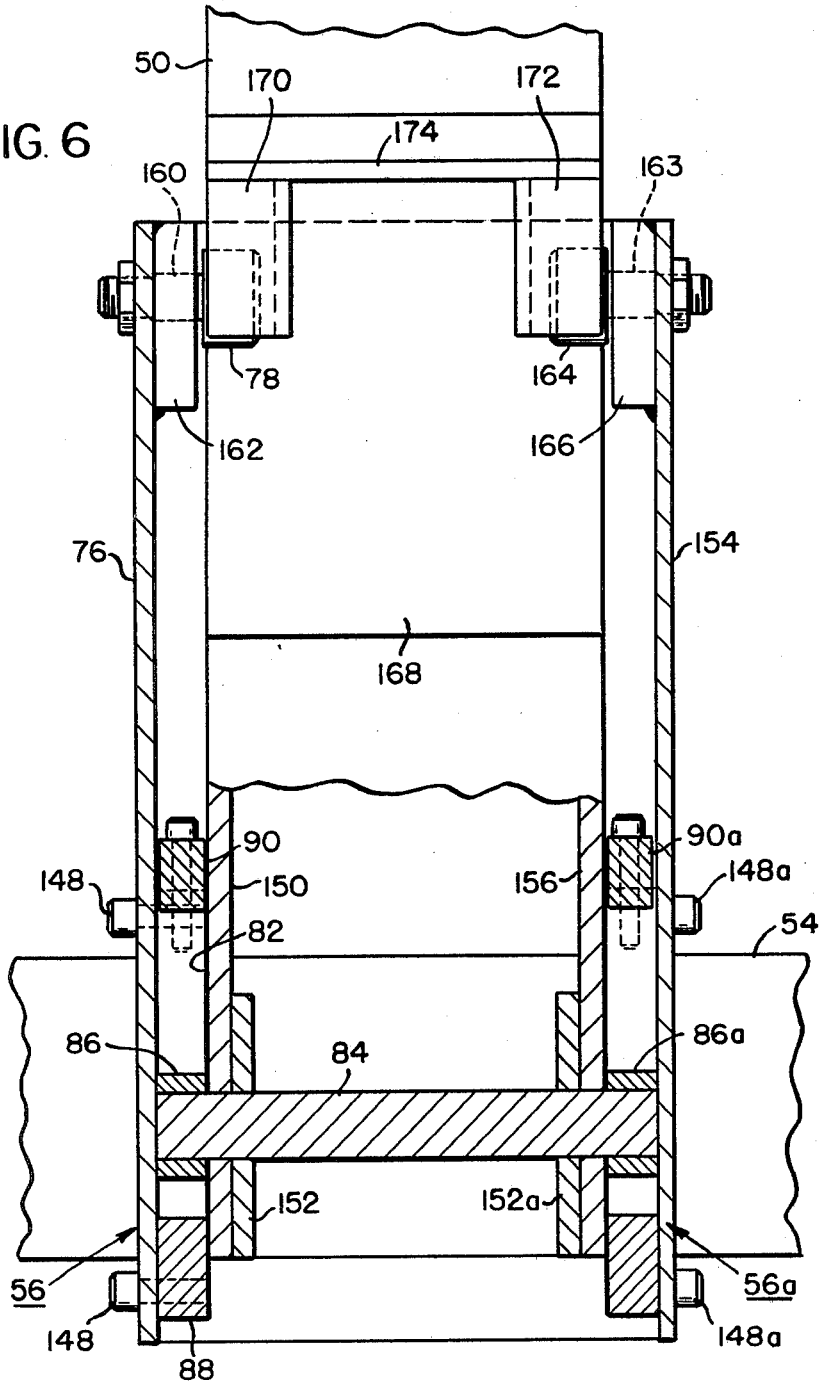
FIG. 6 is a sectional view of the docking station taken along the line 6—6 in FIG. 3.

The upper and lower arms 52 and 54 are essentially yoke shaped as will be apparent from FIGS. 4 and 5. Midway of the arms there are provided steps which support a pair of pads, one of which 58 is shown in FIGS. 1 and 2 on the upper arm 52 and a plurality of pads, one set of which 60 and another of which 62 in the lower arm 54 are shown in FIGS. 1 and 2. The pads in the upper arm 52 define a clamping surface which can bear against areas along the outer edges of the top of the container which are diametrically opposite to each other along a central diameter of the container. The pads in the lower arm 54 define a clamping surface for the bottom of the container which engages the container at three points which are angularly spaced from each other approximately 120° apart. The pad set 60, is closest to the column 50, and a pair of pads, including the pad 62, being on the opposite side of the longitudinal axis 18 from the pad set 60. These pads, because of their angular orientation, provide for equalization of clamping forces and self-alignment of the docking station with the container 14.

A pair of hydraulic actuators, one of which 64 is shown in FIGS. 1 and 2, is utilized to provide forces to tilt and translate the lower arm. Each hydraulic actuator is similar. The actuator 64 has a piston rod 66 reciprocal in its housing, which is a cylinder. The rod 66 is pivotally connected at its free end to a bracket 70 extending upwardly from the lower arm 54. The pin 72 of this pivotal connection is desirably along a diameter of the container 14 which extends through its longitudinal axis 18, thereby equalizing forces on the lower arm 54. Another bracket 74 pivotally connects the opposite end of the hydraulic cylinder actuator 64 to the upper arm 52. It is a feature of this invention that only a pair of hydraulic cylinders or other actuators (e.g., pneumatic, or mechanical) which provide forces upon linear reciprocating motion, is sufficient for operating the docking station to dock and clamp the container 14.

The lower arm 54 also has a pair of plates, one of which 76 is illustrated in FIGS. 1 and 2. These plates extend on opposite sides of the column and have rollers, one of which 78 is shown in FIGS. 1 and 2, near the upper end thereof. These rollers 78 are engageable with the front wall 80 of the column 50 and restrict the motion of the lower arm 54 to translational motion once the arm has tilted to a position where it, like the upper arm 52, are perpendicular to the column 50. The location of the axis of the rollers 78, with respect to the pivot in the mechanism 56, defines this perpendicular relationship during translation of the lower arm 54. When the lower arm 54 is perpendicular to the column 50, the clamping surfaces defined by the pads 58 on the upper arm 52 and the pads 60, 62 on the lower arm 54 are in parallel relationship.

The mechanism 56, which with the hydraulic cylinder 64 provides for the tilting and translational motion, defines a slot 82 in which a shaft 84 is both slidable and pivotal. A bearing block 86 can rotate on the shaft 84. In this embodiment of the invention the slot 82 is effectively in the lower arm. It is provided by a U-shaped member 88 which is closed by a retaining member 90. The U-shaped member is attached to the side plate 76. The shaft 84 is fixed to the column 50. The parts in the mechanism may, alternatively, be reversed with the slot being provided in the column 50 rather than in the lower arm 54 (viz., in the plate 76 thereof, as shown). The illustrated mechanism 56, with the U-shaped member, 88 located between the plate 76 of the lower arm 54 and the side of the column 50 is preferred in that this assembly facilitates the fabrication and enhances the maintainability of the machine 12.

In the loading position, as shown in FIG. 1, the containers, which may be supported on the prongs of a lift truck, are deposited on the pads 60, 62 of the lower arm 54. The male member's prong is located so as to face a target area presented by the end of the female coupling member 38. The hydraulic cylinder 64 and its rod 66 are in extended position as shown in FIG. 1. The extension is limited by the shaft 84 and specifically its bearing block 86 being stopped by the retaining member 90 of the mechanism 56. It will be appreciated, as the description proceeds, that there are two such mechanisms 56, each on an opposite side of the column 50, just as there are two hydraulic cylinder actuators 64. As the hydraulic cylinder actuators pull in, the lower arm 54 pivots about the axis of the shaft 84 until the rollers 78 engage the inside surface 80 of the column 50. Then continued retraction of the rod 66 into the cylinder 64 causes the lower arm to translate upwardly, until the pads 58 in the upper arm are in clamping engagement with the areas along the upper edge of the container with which they engage. If one side of the container is higher than the other, the lower arm 54 may rock laterally until both pads 58 are in alignment with the areas of the upper edge areas of the container against which they will bear.

After additional translational movement the position of the apparatus 10, as shown in FIG. 2, is obtained with the container 14 clamped between the clamping surfaces of the upper and lower arms 52 and 54 defined by their pads 58, 60 and 62. The shaft 84 and its bearing block 86 then is in a position further down along the lower arm than was the case shown in FIG. 1 wherein the container is loaded on the machine 12.

The female coupling member 38 is pivotally connected to its drive shaft 36, preferably by a universal joint 92. The female member includes a rod 96 at the end of which a socket 98 is detent mounted for non-rotating movement, utilizing a spring 100. When the machine is in loading position, as shown in FIG. 1, the socket rests at the bottom of a guide 102 having a generally tapered slot in the upper end thereof (see FIG. 8). The guide is attached to the front wall 80 of the column. The universal joint 92 and the guide 102 position the socket 98 to receive the prong 28 as the container 14 is tilted to bring the axis 20 of the processing bar into horizontal position. Offsets are accommodated by the prong 28 and the freedom of motion of the female member 38 provided by the universal joint 92. As the container and lower arm are translated upwardly, the horizontal axis 20 of the mixing bar comes into alignment with the horizontal axis 40 of the drive shaft. Any misalignments are obviated by the universal joint 92 and by a flexible coupling 94 which may connect the prong 28 to the shaft 26 of the mixing bar which extends from the container 14. The prong and the socket desirably have complimentary, rectilinear cross-sections (hex or square). Even if the prong is not aligned with flats in engagement, this misalignment is accommodated because the socket 98 provides a detent. When the shaft 36 begins to rotate the socket and prong will click or snap into place, and the mixing bar will be rotated.

Referring more particularly to FIGS. 3 through 6, the docking station 16 is shown in greater detail with the upper and lower arms 52 and 54 in the position which they assume when the container is clamped for rotation about the horizontal axis 40 of the drive shaft 34. A flange 104, which engages a cooperating flange 106 (FIG. 2) attached to the end of the drive shaft 34, is connected to the upper arm 52. Struts and braces 108 and 110 are provided to secure the flange 104 to the column 50. These metal parts, as well as others which make up the arms 52 and 54 and the column 50, may be welded together. The arms themselves are sheet metal on their exterior with internal struts (not shown) for stiffening and strengthening. Brackets 112 and 114 in the upper arm 52 extend into a C-shaped opening 116 and define steps (the step 118 of the bracket 112 being shown in FIG. 3) to which the pads 58 are secured. The pads 58, as well as the other pads 60, 62 and 63 may be of elastomeric material, such as rubber. The pads 58 on the upper arm 52 and the brackets 112 and 114 which support these pads are disposed along a diameter 120 through the longitudinal axis 18 of the container. This axis 18 is also on the lateral center line 122 of the upper arm 52. The upper end of the column 50 is connected to the upper arm 52 as by welding.

Stubs 124, 126, 128 and 130 are attached to the upper arm 52 along the surface thereof, which defines the opening 116, to engage and position containers of the size (diameter) which the docking station 16 is designed to receive. Stubs 132 and 134 are attached to the surface of the lower member 54, which defines a C-shaped opening 136 therein. These lower arm stubs 132 and 134 serve a similar purpose as the upper arm stubs 124 to 130. The bracket 74 and a bracket 75 on outer opposite sides of the upper arm 52 are connected to the upper ends of the cylinders 64 and 65 respectively. The lower end of the rod 66 of the cylinder 64 is connected by the pin 72 to the bracket 70 as shown in FIG. 5. The cylinder 64 on the opposite side of the station 16 has its piston rod 67 pivotally connected by a pin 73 to the bracket 77, also as shown in FIG. 5.

The pads in the set 60 consist of two pads **60*a* and 60*b* which are connected to a bracket 138 which forms a step approximately midway between the upper and lower surfaces of the lower arm 54. These pads and the bracket 130 extend into the opening 136 in the lower arm 54. Other brackets 140 and 142 position the pads 62 and 63 in the opening 136, again midway between the upper and lower surfaces of the arm 54. It will be noted that the brackets 140 and 142 are opposed to each other and located on opposite sides of the lateral center line 144 of the lower arm. The center line 144 in the lower arm and the center line 122 in the upper arm are contained within the same plane, essentially perpendicular to the clamping surfaces defined by the pads 60, 62, 63 and 58. Similarly, the center line 120 in the upper arm and the center line 146 which is coaxial with and extends through the axis of the pins 72 and 73 are in the same plane perpendicular to these clamping surfaces when the upper and lower arms are in the position shown in FIGS. 2 and 3–6. Accordingly, the pads 60, 62 and 63 provide evenly distributed clamping forces when the container is bearing against these pads 60, 62 and 63 and against the pads 58 and the upper arm as explained above in connection with FIGS. 1 and 2**.

The mechanism 56 is provided by the U-shaped member 88 attached to the plate 76 by means of bolts 148. The retainer member 90 is bolted to the top of the U-shaped member 88. The slot 82 is defined in the U-shaped member between the plate 76 and a side wall 150 of the column 50. The shaft 84 extends through a hole in the side wall 150 and through a hole in a bracing plate 152 which may be welded to the side wall 150 in the area of the slot 82. The bearing block 86 is a spacer of width slightly less than the width of the slot 86 and is captured in the slot between the opposing surfaces of the column side 150 and the plate 76. A similar mechanism **56*a* for enabling tilting and translational movement of the lower arm 54 is provided between plate 154 and the opposite side wall 156 of the column 50. The parts of this mechanism are labeled with the same reference numerals as used for the parts of the other mechanism 56** with the letter "a" following the reference numeral.

The roller 78 is attached to the upper end of the plate 76 on a shaft 160 which is bolted to the plate 76 and which extends through a spacer 162 welded to the inside surface of the plate 76. A similar roller 164 is bolted to the plate 154 on the opposite side of the column and spaced from the plate 154 by a spacer 166. The rollers 78 and 164 may be supported on their shafts 160 and 163 by ball or roller bearings. Space is provided between the pair of rollers 78 and 164 so as to allow for the location of a snap in pin mechanism which attaches the column 50 to the plates 176 and 154 when the lower arm 54 is translated upwardly to the clamping position. This pin mechanism guards against hydraulic cylinder failure and is not shown to simplify the illustration. A wear plate 168 is attached to the surface of the column 50 which faces the container so as to provide the bearing surface 80 for the rollers 78 and 164.

In order to prevent any tilting of the lower arm 54 when it is in clamping position, guide members 170 and 172 are attached to the column at the wear plate 168. These guide members 170 and 172 are L-shaped in horizontal cross-section, as shown in FIG. 5, and are connected to a top plate 174. The rollers 78 and 164 clear these guide members 170 and 172 until the clamping position is reached. The spaced relationship of the plates 76 and 154 is maintained by rectangular tubes 176 and 180 which extend therebetween.

Figures 7, 8:
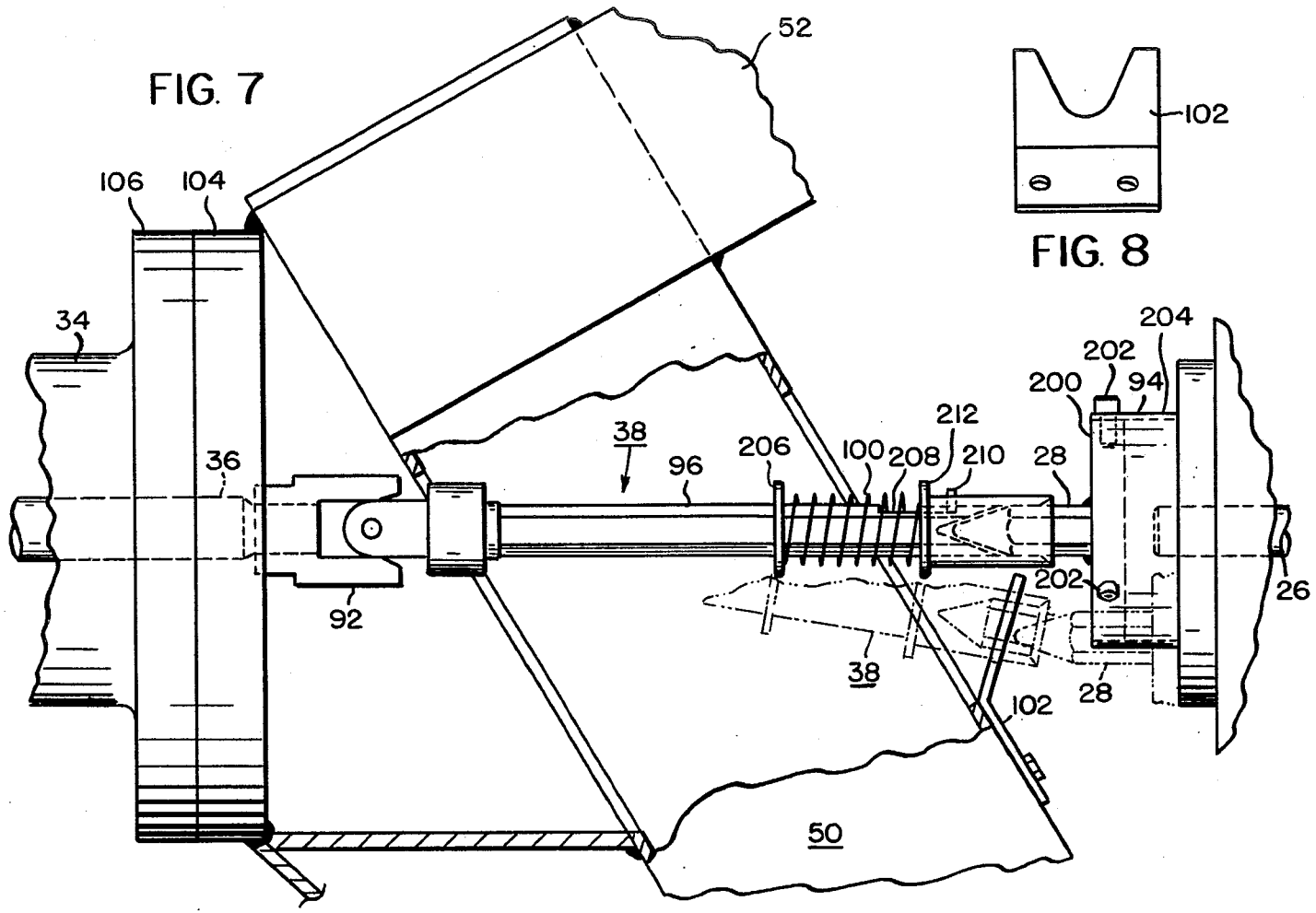
FIG. 7 is a fragmentary view in elevation and partially in section illustrating the automatic coupling means of the containerized solids mixing apparatus shown in FIGS. 1 and 2.
FIG. 8 is a detailed view, taken from the side, of the guide for the female member of the coupling illustrated in FIG. 7.

Referring next to FIGS. 7 and 8, the male 28 and female 38 interengageable members which define the coupling between the mixing bar shaft 26 and its drive shaft 36 (the high speed drive shaft) are shown. The phantom view of the interengageable members 28 and 38 illustrate their positions after the container has tilted, but before translation has commenced. The prong of the male member 28 may be a piece of hex rod stock with a tapered end which is welded to a disk 200. This disk 200 is connected to the flexible coupling 94 by bolts 202. This coupling may be of the type which has spring steel cantilever beams connecting a shell 204 to a sleeve which is keyed to the mixing bar shaft 26. One-half of a DELTAFLEX coupling sold by Allen Couplings Inc., of Chesterland, Ohio may be suitable. The flexible coupling assists in compensating for offsets between the coupling members 28 and 38 due to misalignment, dimensional variations and the like.

The female member 38 has a hex rod 96 which is attached to the universal joint 92. A washer 206 is connected, as by welding to the rod 96. The rod 96 also has a slot 208 in which the sleeve of the socket 98 is captured by a pin 210. The pin 210 slidably and non-rotatably secures the socket to the rod 96. The interior surface of the socket 98 also has a hex cross-section so as to mate with the flats of the hex prong 28. The spring 100 is captured between the welded washer 206 and a washer 212 which bears against the inner end of the sleeve of the socket 98. The spring 100 biases the socket 98 outwardly and enables the socket to provide a detent for aligning itself into engagement with the prong 28. The socket rests in the yoke of the guide 102 until the socket is engaged by the prong. Then the male and the female coupling member 38, which extends through an opening 101 in the wall 80 of the column 50, is lifted to horizontal position at which time driving of the mixing bar can commence. If the flats on the prong 28 are not in alignment with the flats of the inner periphery of the socket, they will click or snap into alignment when rotation of the drive shaft 36 commences.

From the foregoing description it will be apparent that there has been provided improved solids mixing apparatus. Variations and modifications of the herein described apparatus within the scope of the invention will undoubtably suggest themselves to those skilled in the art. Accordingly, the foregoing description should be taken as illustrative and not in a limiting sense.

We claim:

1. Solids mixing apparatus comprising portable containers in which the solids to be mixed are carried and in which a mixing bar is rotatably mounted, said container having a longitudinal axis extending between the top and bottom thereof and said mixing bar being disposed at an angle of less than 90° with respect to said longitudinal axis, a mixing station in which said containers are individually received and rotated with asymmetrical motion of the longitudinal axis thereof about a horizontal axis, said station having first and second drive shafts rotatable about a horizontal axis, a frame attached to said first drive shaft having a member disposed at said angle with a fixed upper arm presenting a first clamping surface and a lower arm moveably connected to said member and presenting a second clamping surface, means mounting said lower arm to said member to provide compound tilting and translational movement of said second clamping surface between the horizontal and a position paralleling said first clamping surface and in the direction along said member whereby the container can be received upon said second clamping surface while horizontal, tilted and translated into clamping relationship with said first and second clamping surfaces, and coupling means having interengageable male and female members, one of which is connected to said mixing bar and the other to said second drive shaft, said members having mating drive surfaces rectilinear in cross-section, said coupling means also having means mounting one of said interengageable members as a detent for enabling said drive surfaces to align and engage each other in driving relationship upon initiation of rotation of said second shaft.

2. Solids mixing apparatus according to claim 1, wherein said station further comprises actuator means having a housing and a moveable rod constrained for reciprocating movement in said housing, one of said housing and said rod being coupled to said lower arm and the other to a fixed position on said station, said rod being retractable for tilting and translating said lower arm.

3. Solids mixing apparatus according to claim 2, wherein the couplings between said housing and said rod and said lower arm and said station are provided by pivotal connections to said housing and rod.

4. Solids mixing apparatus according to claim 3, wherein said pivotal connections are to said upper arm and said lower arm.

5. Solids mixing apparatus according to claim 4, wherein said actuator is provided by a pair of hydraulic cylinders disposed in parallel relationship to each other for providing equal forces at opposite sides of said lower arm.

6. Solids mixing apparatus according to claim 1, wherein said lower arm mounting means comprises a shaft, a slot in one of said lower arm and member extending in the direction between said upper and lower arms, said shaft being slidably mounted in said slot and providing a pivotal mount for tilting movement of said lower arm, means for restricting said lower arm to translational movement longitudinally of said member when said shaft is rotated and said lower member is tilted to said position with said second clamping surface paralleling said first clamping surface, and actuator means pivotally connected to said lower arm outwardly from said shaft for tilting and translating said lower arm.

7. Solids mixing apparatus according to claim 6, wherein said pivotal connection to said lower arm is provided outwardly of said container when said container is disposed in said lower arm and along line essentially through the longitudinal axis of said container.

8. Solids mixing apparatus according to claim 7, wherein a pair of actuators are provided with their pivotal connections to said lower arm outward from said container along said line on opposite sides of the longitudinal axis of said container.

9. Solids mixing apparatus according to claim 8, wherein said second clamping surface is provided by a plurality of pads attached to said lower arm and bearing against areas of said container along the lower edge thereof, at least one of said pads defining a bearing region along a line essentially mutually perpendicular to a plane containing said line of said pivotal connection and the longitudinal axis of said container, a pair of said plurality of pads defining a pair of bearing regions along the lower edge of said container, each on the opposite side of said plane containing said line of said pivotal connections, and said first clamping surface of said upper arm being defined by a pair of pads bearing against areas of said container along the upper edge thereof, said upper arm pads being disposed essentially in said plane containing said line of said pivotal connections on opposite sides of said longitudinal axis whereby to enable equalization of clamping forces to said container upon clamping thereof between said upper and lower arms.

10. Solids mixing apparatus according to claim 6, wherein said member is a column having a surface facing said container and sides generally perpendicular to said container facing surface thereof, said lower arm having plates extending longitudinally of said member along the sides of said column, said slot having means at the upper end thereof for locating said lower arm with said second clamping surface horizontal, roller means extending in a direction between said side plates, rotatably connected thereto and spaced outwardly from said shaft, said roller means being engageable with said container facing surface for restricting said lower arm to translational movement longitudinally of said column when said lower arm is tilted to bring said second clamping surface into parallel relationship with said first clamping surface of said upper arm.

11. Solids mixing apparatus according to claim 10, further comprising roller guide means connected to said container facing surface of said column and defining a passage for receiving and retaining said roller means during said translational motion of said lower arm.

12. Solids mixing apparatus according to claim 10, wherein said slot is provided by means connected to said lower arm plates and defining a pair of slots, each of said slots extending longitudinally essentially perpendicular to said second clamping surface, said shaft being fixedly connected to said column and extending outwardly into said slots, and bearing blocks moveable with said shaft in each of said pair of slots, said shaft being journaled in said bearing blocks.

13. Solids mixing apparatus according to claim 12, wherein said means defining said slots comprises "U" shaped members on said plates and between said plates and the sides of said column, and retainer members closing said slots in said U-shaped members at the top thereof, said retaining members having surfaces facing said slots defining said upper end thereof and the interior of the bottom of said U-shaped member defining a surfaces limiting the translational movement of said lower arm.

14. Solids mixing apparatus according to claim 1, further comprising means pivotally mounting said other of said interengageable members to said second drive shaft to depend from the horizontal to a position to receive said one of said members which is connected to said mixing bar when said container is tilted.

15. Solids mixing apparatus according to claim 14, wherein said member to which said upper and lower arms are attached has an opening through which said other of said interengageable members extends and guide means defining a yoke attached to said member and extending at least partially across said opening for retaining said other member in said position to receive said one of said interengageable members.

16. Solids mixing apparatus according to claim 15, wherein said means pivotally mounting said other of said interengageable members is a universal joint.

17. Solids mixing apparatus according to claim 16, further comprising a flexible joint connecting said one of said interengageable members to said mixing bar.

18. Solids mixing apparatus according to claim 1, wherein said male interengageable member is a prong having a rectilinear cross section, said prong being tapered at the end thereof facing said female member.

19. Solids mixing apparatus according to claim 18, wherein said female interengageable member comprises a rod, a sleeve reciprocably mounted in nonrotating relationship on said female member rod, said sleeve defining a socket having an inner periphery rectilinear in cross-section and complementary to said rectilinear cross-section of said male member, and means including a spring biasing said socket sleeve outwardly from the end of said rod to define said detent.

20. Solids mixing apparatus according to claim 19, wherein said rod has a slot, a pin extending from said socket sleeve into said slot for reciprocally mounting said socket sleeve in non-rotating relationship upon said female member rod, and a spring coiled around said rod and bearing against the end of said socket sleeve opposite from the socket end thereof.

21. Solids mixing apparatus according to claim 19, further comprising a universal joint mounting the end of said female rod opposite from the end thereof encompassed by said socket sleeve for connecting said female member rod to said second drive shaft and enabling said female member to depend from the horizontal position to receive said male member prong and return with said male member prong essentially to horizontal position when said container is tilted.

22. In solids mixing apparatus for use with portable containers in which solids to be mixed are carried and having a horizontal drive shaft, a docking station connected to said shaft for receiving a container having a longitudinal axis with its said longitudinal axis essentially vertical, tilting said container to an angle of less than 90° to the horizontal and retaining said container while it is rotated with asymmetrical motion of the longitudinal axis thereof with respect to the axis of said horizontal drive shaft, said docking station comprising a frame connected to said horizontal drive shaft, said frame having a member disposed at said angle with a fixed upper arm providing a first clamping surface and a lower arm moveably connected to said member and presenting a second clamping surface, means mounting said lower arm to said member to provide compound tilting and translational movement of said second clamping surface between the horizontal and a position paralleling said first clamping surface and in the direction along said member whereby the container can be received upon said second clamping surface while horizontal, tilted and translated into clamping relationship with said first and second clamping surfaces.

23. The invention according to claim 22, wherein said station further comprises actuator means having a housing and moveable rod constrained for reciprocating movement in said housing, one of said housing and said rod being coupled to said lower arm and the other to a fixed position on said station, said rod being retractable for tilting and translating said lower arm.

24. The invention according to claim 23, wherein the couplings between said housing and said rod and said lower arm and said station are provided by pivotal connections to said housing and rod.

25. The invention according to claim 24, wherein said pivotal connections are to said upper arm and said lower arm.

26. The invention according to claim 25, wherein said actuator is provided by a pair of hydraulic cylinders disposed in parallel relationship to each other for providing equal forces at opposite sides of said lower arm.

27. The invention according to claim 22, wherein said lower arm mounting means comprises a shaft, a slot in one of said lower arm and member extending in the direction between said upper and lower arms, said shaft being slidably mounted in said slot and providing a pivotal mount for tilting movement at said lower arm, means for restricting said lower arm to translational movement longitudinally of said member when said shaft is rotated and said lower member is tilted to said position with said second clamping surface paralleling said first clamping surface, and actuator means pivotally connected to said lower arm outwardly from said shaft for tilting and translating said lower arm.

28. The invention according to claim 27, wherein said pivotal connection to said lower arm is provided outwardly of said container when said container is disposed in said lower arm and along a line essentially through the longitudinal axis of said container.

29. The invention according to claim 28, wherein a pair of actuators are provided with their pivotal connections to said lower arm outward from said container along said line on opposite sides of the longitudinal axis of said container.

30. The invention according to claim 29, wherein said second clamping surface is provided by a plurality of pads attached to said lower arm and bearing against areas of said container along the lower edge thereof, at least one of said pads defining a bearing region along a line essentially mutually perpendicular to a plane containing said line of said pivotal connection and the longitudinal axis of said container, a pair of said plurality of pads defining a pair of bearing regions along the lower edge of said container, each on the opposite side of said plane containing said line of said pivotal connections, and said first clamping surface of said upper arm being defined by a pair of pads bearing against areas of said container along the upper edge thereof, said upper arm pads being disposed essentially in said plane containing said line of said pivotal connections on opposite sides of said longitudinal axis whereby to enable equalization of clamping forces to said container upon clamping thereof between said upper and lower arms.

31. The invention according to claim 30, wherein said slot is provided by means connected to said lower arm plates and defining a pair of slots, each of said slots extending longitudinally essentially perpendicular to said second clamping surface, said shaft being fixedly connected to said column and extending outwardly into said slots, and bearing blocks moveable with said shaft in each of said pair of slots, said shaft being journaled in said bearing blocks.

32. The invention according to claim 31, wherein said means defining said slots comprises "U" shaped members on said plates and between said plates and the sides of said column, and retainer members closing said slots in said U-shaped members at the top thereof, said retaining members having surfaces facing said slots defining said upper end thereof and the interior of the bottom of said U-shaped members defining a surfaces limiting the translational movement of said lower arm.

33. The invention according to claim 27, wherein said member is a column having a surface facing said container and sides generally perpendicular to said container facing surface thereof, said lower arm having plates extending longitudinally of said member along the sides of said column, said slot having means at the upper end thereof for locating said lower arm with said second clamping surface horizontal, roller means extending in a direction between said side plates, rotatably connected thereto and spaced outwardly from said shaft, said roller means being engageable with said container facing surface for restricting said lower arm to translational movement longitudinally of said column when said lower arm is tilted to bring said second clamping surface into parallel relationship with said first clamping surface of said upper arm.

34. The invention according to claim 33, further comprising roller guide means connected to said container facing surface of said column and defining a passage for receiving and retaining said roller means during said translational of said lower arm.

35. In solids mixing apparatus having a mixing bar drive shaft wherein a portable container in which solids to be mixed are carried and are revolved and wherein said container has a mixing bar which is rotatably mounted therein, a coupling for connecting said mixing bar to said drive shaft therefor which comprises male and female members which are interengageable with each other and one of which is connected to said mixing bar and the other to said drive shaft, said members having mating drive surfaces rectilinear in cross-section, and means mounting one of said members as a detent for enabling said drive surfaces to align and engage each other in driving relationship upon initiation of rotation of said shaft.

36. In solids mixing apparatus according to claim 35, wherein the axis of said drive shaft is horizontal and said container has a longitudinal axis and is tilted to bring the longitudinal axis thereof to an angle of less than 90° to the horizontal whereby said container can be rotated with asymmetrical motion of the longitudinal axis thereof with respect to the horizontal, wherein said coupling further comprises means pivotally mounting said other of said interengageable members to said drive shaft to depend from the horizontal into a position to receive said one of said interengageable members which is connected to said mixing bar when said container is tilted.

37. The invention according to claim 36, further comprising guide means defining a yoke for retaining said other member in position to receive said one of said interengageable members until said container is tilted.

38. The invention according to claim 37, wherein said means pivotally mounting said other of said interengageable members is a universal joint.

39. The invention as set forth in claim 36, wherein said female interengageable member comprises a rod, a sleeve reciprocably mounted in non-rotating relationship on said female member rod, said sleeve defining a socket having an inner periphery rectilinear in cross-section and complementary to said rectilinear cross-section of said male member, and means including a spring biasing said socket sleeve outwardly from the end of said rod to define said detent.

40. The invention as set forth in claim 40, wherein said rod has a slot, a pin extending from said socket sleeve into said slot for reciprocally mounting said socket sleeve in non-rotating relationship upon said female member rod, and a said spring being coiled around said rod and bearing against the end of said socket sleeve opposite from the socket end thereof.

41. The invention as set forth in claim 40, further comprising a universal joint mounting the end of said female rod opposite from the end thereof encompassed by said socket sleeve for connecting said female member rod to said drive shaft and enabling said female member to depend from the horizontal position to receive said male member prong and return with said male member prong essentially to horizontal position when said container is tilted.

42. The invention as set forth in claim 35, wherein said male interengageable member is a prong having a rectilinear cross section, said prong being tapered at the end thereof facing said female member.

43. The invention as set forth in claim 42, further comprising a flexible joint connecting said one of said interengageable members to said mixing bar.

* * * * *